US005624312A

United States Patent [19]

Collier

[11] Patent Number: 5,624,312

[45] Date of Patent: Apr. 29, 1997

[54] WORK-STATION WITH CLIMATE CONTROL CAPABILITIES

[76] Inventor: William R. Collier, 305 De La Commune, Apt. 42, Montreal, Quebec, Canada, H2Y 2E1

[21] Appl. No.: 489,042

[22] Filed: Jun. 9, 1995

[51] Int. Cl.[6] ..... F24F 7/08

[52] U.S. Cl. ..... 454/247; 454/186; 454/306

[58] Field of Search ..... 454/185, 186, 454/241, 245, 247, 306

[56] References Cited

U.S. PATENT DOCUMENTS

| | | | |
|---|---|---|---|
| 1,194,527 | 9/1916 | McNamara | 454/247 |
| 1,329,802 | 2/1920 | Scherer | 454/247 |
| 1,329,804 | 2/1920 | Scherer | 454/247 |
| 2,729,429 | 1/1956 | Goemann | 454/185 X |
| 3,516,347 | 6/1970 | May | 454/185 |
| 4,353,411 | 10/1982 | Harter et al. | 454/306 X |
| 5,468,184 | 11/1995 | Collier | 454/186 |

OTHER PUBLICATIONS

"Work on Wheels", (from Workplace: The New Look, The Wall Street Journal, Jun. 4, 1990, p. R31; R3) illustrating concept by Daedalus Design from the Center for Building Performance and Diagnostics, Carnegie Mellon University, Pittsburgh, Pa.

*Primary Examiner*—Harold Joyce

*Attorney, Agent, or Firm*—James T. FitzGibbon

[57] ABSTRACT

A work station for supplying conditioned air and electrical conductors to the vicinity of a worker, for withdrawing return air from the space near the worker and for seating the worker and positioning his/her equipment. The work station includes a services distributor with vertically extending but separated passageways dedicated exclusively to supply air, return air and electrical wiring. A portion of the structure contains adjustable support arms for positioning equipment to be used by the workers; the seat is positioned adjacent the service distributor. Communication spaces are provided at spaced apart points whereby the services may leave or enter their vertically extending spaces and travel generally horizontally to those areas in which the services needed or are to be used. The apparatus preferably, but not necessarily, includes a task lighting that illuminates the area surrounding the worker and/or the equipment positioned by the support arms.

11 Claims, 5 Drawing Sheets

WORK-STATION WITH CLIMATE CONTROL CAPABILITIES

BACKGROUND OF THE INVENTION

The present invention relates generally to work stations used in office and industrial applications, and more particularly, to a composite work station that most advantageously interfaces with specialized arrangements of services needed by office and technical workers.

Most particularly, one aspect of the invention relates to a unitized work station which includes a compact, individually adjustable system for circulating conditioned air in the vicinity of a worker, that is, to provide both supply and return air capability suitably localized and controlled by the user. Another aspect relates to the provision of electrical/data services including power and data conductors and other services if desired. A further aspect is to provide adjustable positioners for work station equipment such as keyboards, viewing display equipment, specialized lighting and the like as well as providing user seating that is desirably positioned relative to the services being supplied through the station. Other optional features are readily provided.

In its present form, the apparatus is best utilized in connection with a multi-level raised floor service arrangement of the type to be described herein; however this is not strictly necessary. Also, in its preferred form, the entire system is mounted on a single platform such as a round support plate, optionally mounted for rotation.

In recent years, there has been a constantly increasing preoccupation with employee productivity. Attempts of all sorts have been made to improve the productivity of office and technical workers, including secretarial personnel; engineers such as designers, estimators and the like; workers controlling manufacturing operations; and a vast array of accountants, bookkeepers and others who are continually required to work with technical information.

One aspect of this emphasis has been that of providing more and more highly capable, faster operating equipment. By way of example, secretarial stations that formerly used typewriters now include computerized word processors having not only the capability of word processing, but also interconnection to other computers by way of local area networks, communications, connections such as those required to send messages by telefax, and a variety of so-called modems or other connections adapted to supply or exchange information with remote work stations in digital or other encoded form.

Clerical workers, including office and engineering and underwriting personnel, for example, have also been equipped with a wide variety of messaging equipment including telephones, image display apparatus such as CRT's, etc., clip-on type miniaturized microphones and earphones for portable, wireless telephony and like equipment. These "advances" have become increasingly common in an continuing effort to increase the productivity of employees.

However, critical observers of such so-called progress have noted that mere addition of equipment does not necessarily mean greater productivity, especially over an extended time period. Such observers have noted that the stress level of most employees so situated and equipped has also risen significantly in recent years. Managers at various levels have increasingly noted that the mere presence of more and faster-operating equipment is not itself sufficient to insure increased productivity.

In particular, overcrowding of desks, and creating the feeling in an employee that he or she is surrounded by equipment requiring constant attention, has often caused significantly adverse emotional reactions, ranging from concern to fear and hostility, all of which have actually proven counterproductive to the announced and hoped-for goal of increased employee productivity.

In recent years, managers have reluctantly agreed that employee comfort in and around the work place has become a paramount consideration if such an employee is to continue to work at high levels with sufficient comfort that the inevitable job-generated stress may be reduced, kept low, and/or effectively managed. It has been found that true productivity, which combines work rate with minimizing mistakes and insuring employee longevity on the job so that beneficial experience can be taken advantage of, is facilitated by employee comfort and convenience.

With these realizations regarding psychological considerations have come the counterpart realizations that reasonable physical comfort is also a necessity for effective operation. By "physical comfort" as used in this sense is not meant simply pampering employees or catering to unsubstantial whims, but is meant comfort in the broader sense of adapting the surrounding space to the surrounding to the physiological needs of the employee. In particular, it has been recently realized that a supply of truly fresh, conditioned air at the proper temperature is a requirement for effective human performance, especially performance of mental work.

Moreover, a comfortable seating position and comfortable position of equipment relative to the employee has become a true necessity. Thus, in recent years, ergonomics has moved toward becoming a true science rather than a luxury. For example, proper positioning and/or variability of positioning of keyboards or other manually operated devices have been accepted as a way of greatly reducing or eliminating repetitive motion stress such as carpal tunnel syndrome. Proper positioning of screens and monitors is able to overcome employee discomfort and even visual damage by eliminating glare and reflections. Most important of these, however, has been the requirement for air which is fresh, but the circulation of which need not be and in fact must not be annoying to the user. Discomfort from air circulation need no longer be considered simply a price to be paid for the necessity of having fresh air available for the worker.

Regarding prior attempts to provide comfort for office workers, the widely accepted system of ceiling supply and ceiling return has not proved highly effective in actual practice, primarily because such a system basically works against natural convection. Almost everyone is familiar with complaints of workers that depend on the position of such workers relative to the conditioned air outlets. For example, being situated beneath a conditioned air outlet, particularly on a warm day, is almost certain to create various levels of discomfort in office workers. Yet, if a significant amount of air is to be supplied to such offices, their cold air drafts become inevitable, with the coldest air being the most dense and moving most rapidly down under towards the employees with the additional impetus of delivery under forced air circulation conditions. If hot air is being supplied, it often stays near the ceiling unless forced toward the floor by strong drafts. Most, if not all, existing ceiling supply/return systems do not offer the option of moving the outlets to the vicinity of the employee.

Supplying conditioned air through the floor has proven very effective for circulation in environments wherein human comfort is not a particularly significant factor, i.e., computer rooms. However, a large volume of cold air supply from the floor is simply not acceptable to most office workers. The concept of reversible supply and return air, with floor supply and ceiling return for heat and vice versa for cold are possibilities that have been mentioned in the past, but such concepts are usually too expensive, space-intensive and complex to be workable in reality.

Under these circumstances, it would be greatly desired to provide an office or like work area where air was circulated with a view towards increasing individual user comfort and meeting individual user needs rather than being laid out as a part of an overall plan into which all employees would ultimately be required to fit. Thus, an ideal air circulation pattern would be one that would provide individually controllable comfort to each employee, and, if possible, which would arrange for convective circulation in the vicinity of the employee, regardless of the number or positioning of such employees within an office space.

With the foregoing in mind, and in particularly, the failure of the prior art to provide a consistently favorable climate for office workers, it is an object of the present invention to provide an improved, integrated work station providing a number of advantages in use.

Another object of the invention is to provide a work station wherein all the services ordinarily used as well as generally needed by an employee are immediately available and can be individually adjusted or controlled by that employee.

Yet another object of the invention is to provide an integrated employee work station that includes its own individual supply air space, a return air space, an electrical space, and also preferably includes an employee seat and adjustable equipment positioning facilities.

A further object of the invention is to provide a modular work station which permits an employee to adjust the climate in his or her individual work area without significantly affecting the climate of adjacent areas.

A still further object is to provide a work station which does not require, but is adaptable for use with a multi-level underfloor service distribution system.

An additional object of the invention is to provide a work station that includes a columnar arrangement of services, providing a generally cylindrical or like column having its interior subdivided into isolated spaces such as a center or core air supply area, an intermediate space in the form of a cylindrical shell adapted to receive return air and direct it to a return air plenum or other destination and a third, preferably radially outermost space dedicated to conductors, including electrical power and/or signal conductors such as data cables, fiber optic communication cables or the like.

Another object of the invention is to provide an arrangement of spaces within a single column whereby supply air, return air, and communication spaces are isolated from each other and yet adjacently disposed for compact packaging and for convenient availability and distribution.

Yet another object of the invention is to provide a column-like arrangement, preferably circular in cross-section, that includes air supply, air return, and communication spaces and which also includes a plurality of equipment positioners that are individually adjustable by the user for maximum comfort and effectiveness.

A further object of the invention is to provide a work station of the type described wherein the entire structure of the station is mounted on a single support such as a plate or the like and wherein a concentric arrangement of service spaces is able to be integrated with a multi-level distribution system, preferably a floor system that is divided into separate levels providing supply air, return air, and communication and power spaces.

A still further object of the .invention is to provide an arrangement in a work station whereby the same structure that provides the services also provides support for equipment that is positionable according to the desires of the user.

An additional object of the invention is to provide a work station wherein the equipment positioners are in the form of rotatable rings, optionally motor driven, supported on a fixed column, with the rings including inner and outer mounting areas and vertically open spaces permitting passage of electrical or data conductors therethrough.

A further object of the invention is to provide a work station wherein a lower portion includes a return air space and a dedicated electrical space terminating in a power outlet area to which removable power and/or data connections can be made with ease and simplicity, leaving the upper and middle portions of the station available for other services.

The foregoing and other objects and advantages of the invention are achieved in practice by providing a modular work station including a column having plural isolated vertical passages individually dedicated to supply air, return air and communication and/or power, each of the services being able to serve a wide angle arc around the work station area.

The invention also achieves its objects by providing such an apparatus that further includes adjustable equipment positioners, climate and/or accessory control systems, and optionally seating, lighting and/or other operator-positionable equipment.

The exact manner in which the foregoing and other objects and advantages of the invention are achieved in practice will become more clearly apparent when reference is made to the following detailed description of the preferred embodiments of the invention set forth by way of example and shown in the accompanying drawings wherein like reference numbers indicate corresponding parts throughout.

DESCRIPTION OF THE PREFERRED EMBODIMENTS OF THE INVENTION

While the work station of the present invention may be made from different materials and may be embodied in various shapes and forms, the preferred forms are arranged to use the minimum number of components in the simplest form to provide the functions of climate control, power and communication supply and equipment positioners, all arranged to provide the greatest operational flexibility.

Figure 1:
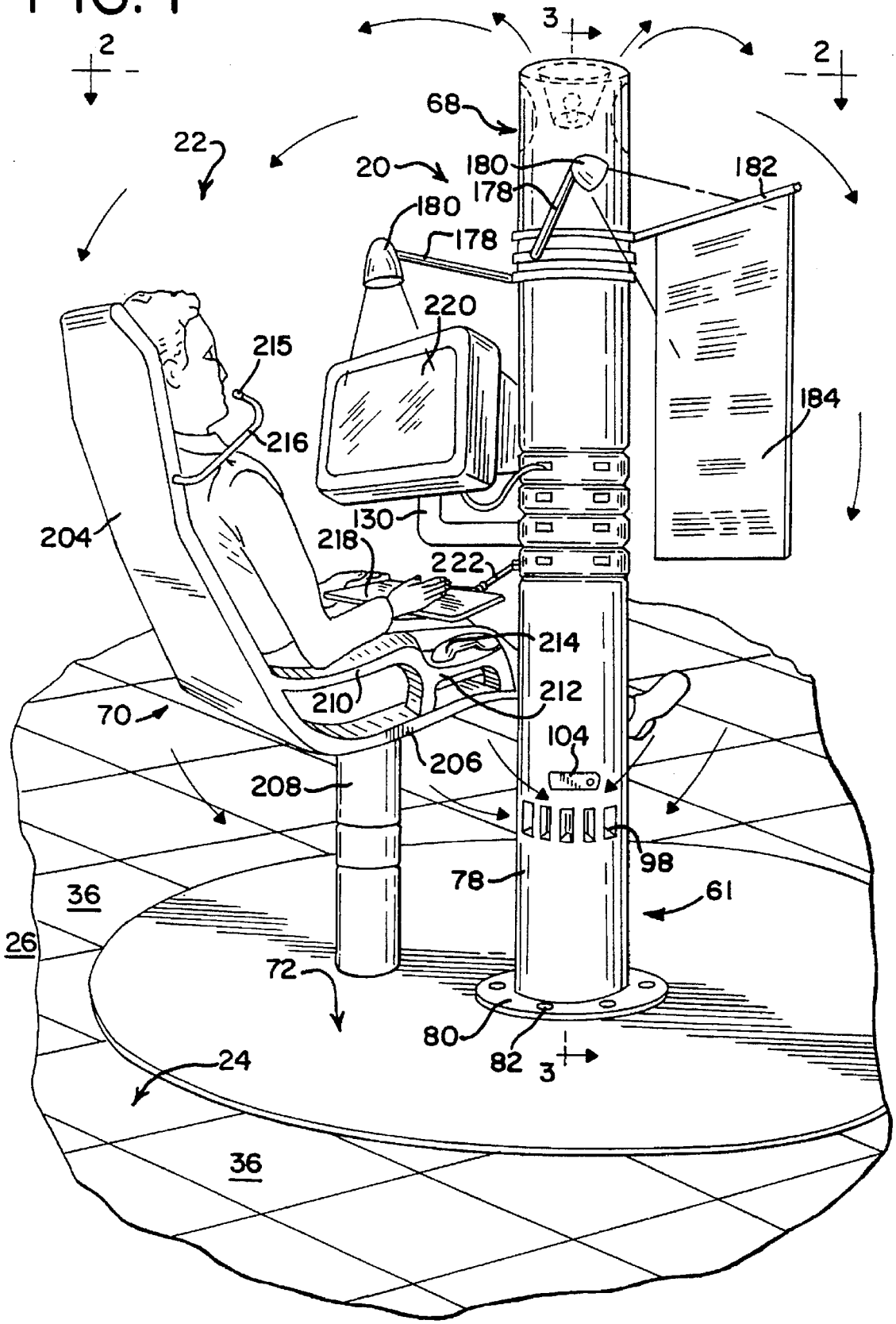
FIG. 1 is a perspective view of the work station with climate control capabilities made according to the invention and showing the same with an operator in position of use and the work station positioned on a preferred form of floor structure.
Figure 2:
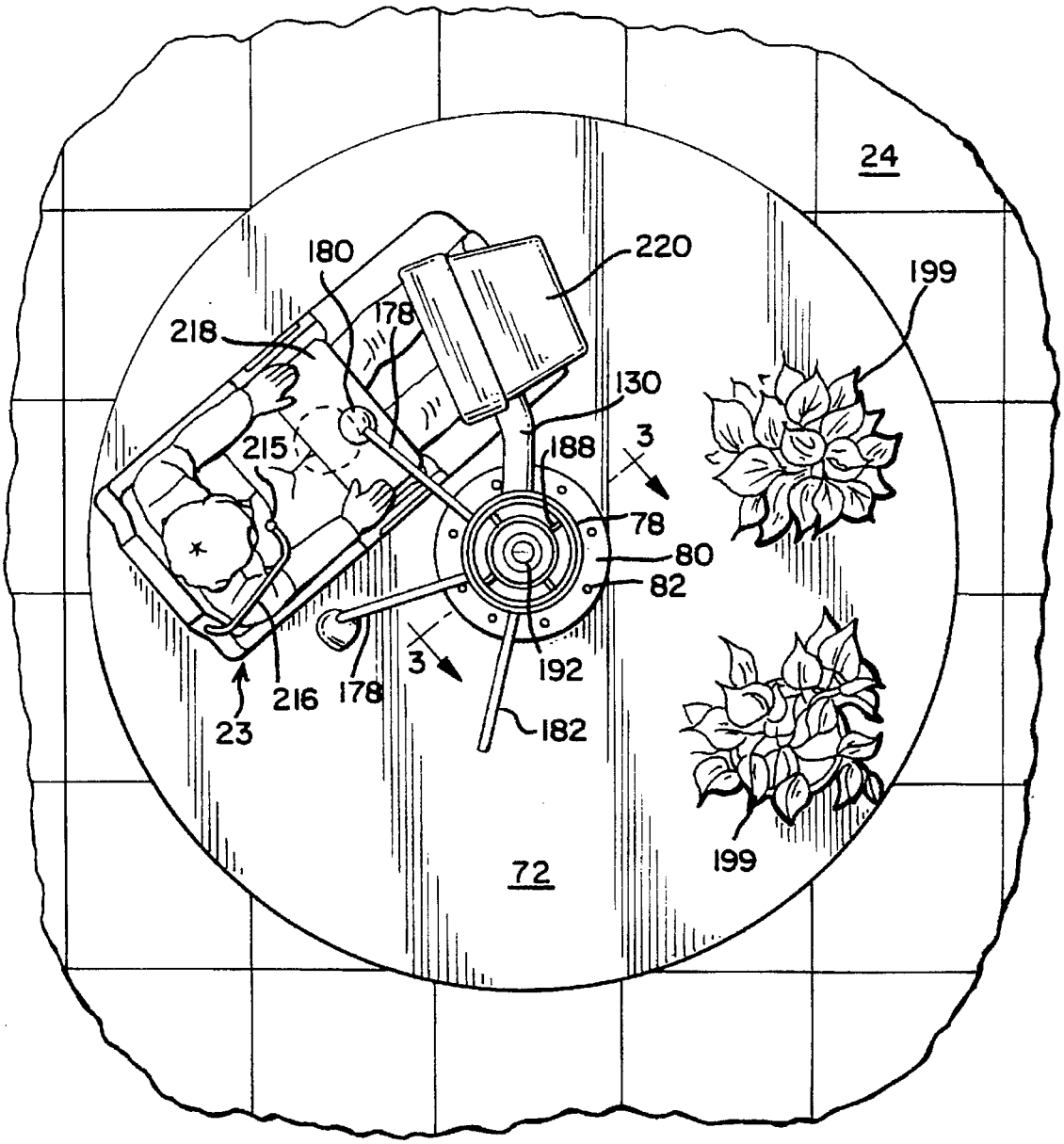
FIG. 2 is a top plan view of the work station of the invention, showing the arrangement of the seating system and the positioning of various portions of the equipment used by the operator, including lighting, a telephone, a keyboard and a viewing monitor and showing the position of potted trees or plants positionable about the periphery of the station.
Figures 3, 4:
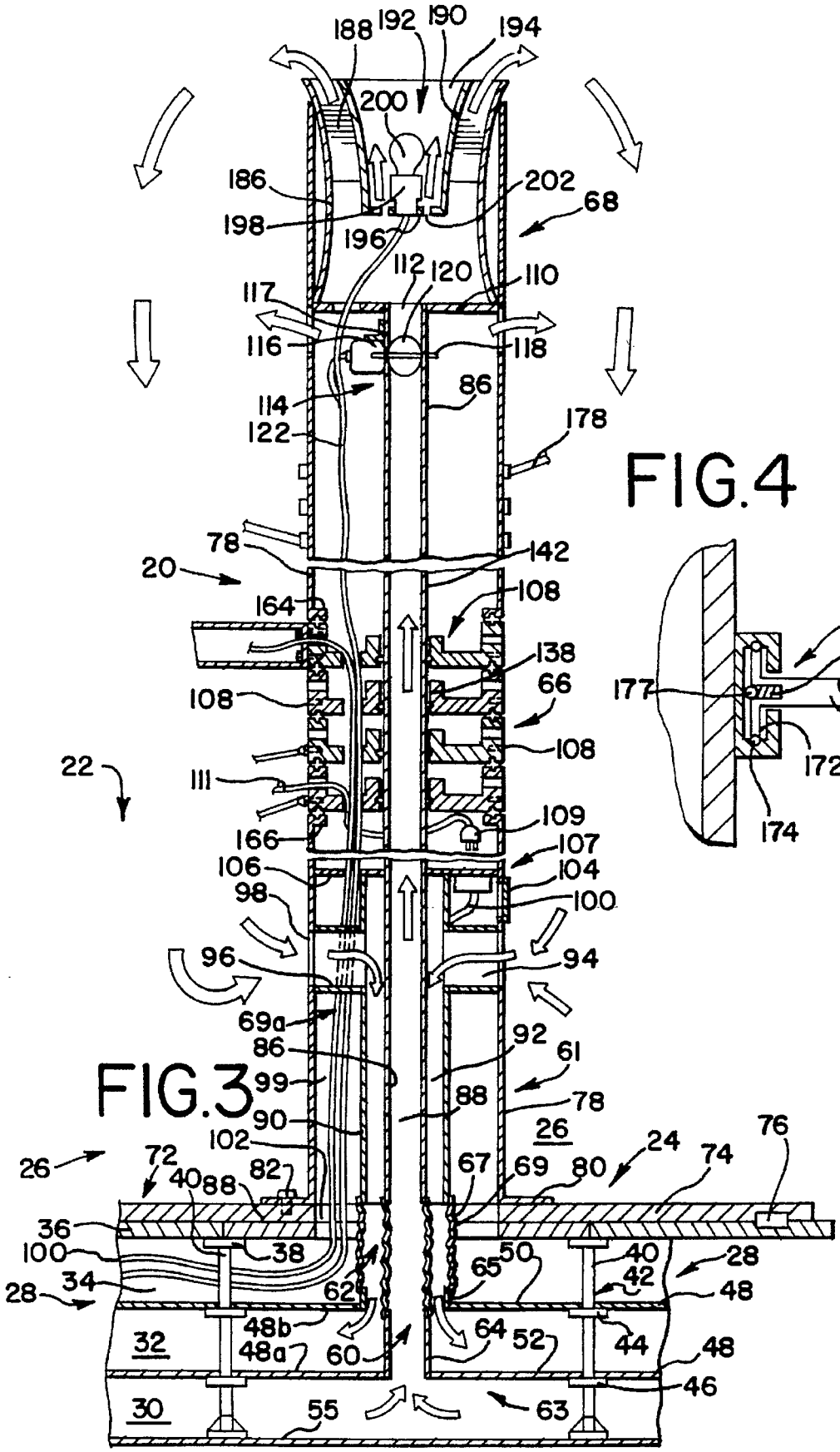
FIG. 3 is a vertical sectional view, with portions broken away, showing the portions of the work station of FIG. 1 and the subfloor area beneath the station, taken along lines 3—3 of FIG. 2.
FIG. 4 is a greatly enlarged fragmentary vertical sectional view of the track-style mounting arrangement for the lights or other lightweight components of the work station of the invention.

Referring now to the drawings in greater detail, one illustrative embodiment of the invention is shown in FIGS. 1–3 to comprise a work station generally designated 20 positioned within an interior office space generally designated 22 and divided by a work area floor generally designated 24 into an upper, work area space generally designated 26 and a lower or subfloor air and electrical distribution space generally designated 28.

According to the invention, the subfloor space 28 is subdivided into plural, substantially unobstructed, area-wide plenums comprising respectively a supply air space 30, a return air space 32 and a wireway space 34. For this purpose, the work area floor 24 is preferably comprised of a plurality of readily removable panels 36 each supported at its corners by top brackets 38 on the upper ends 40 of columns generally designated 42 having plural intermediate brackets 44, 46 each supporting sets of stringers 48 upon which are supported upper and lower isolator pans 50, 52, preferably made from 14–18 gauge sheet metal.

Figure 7:
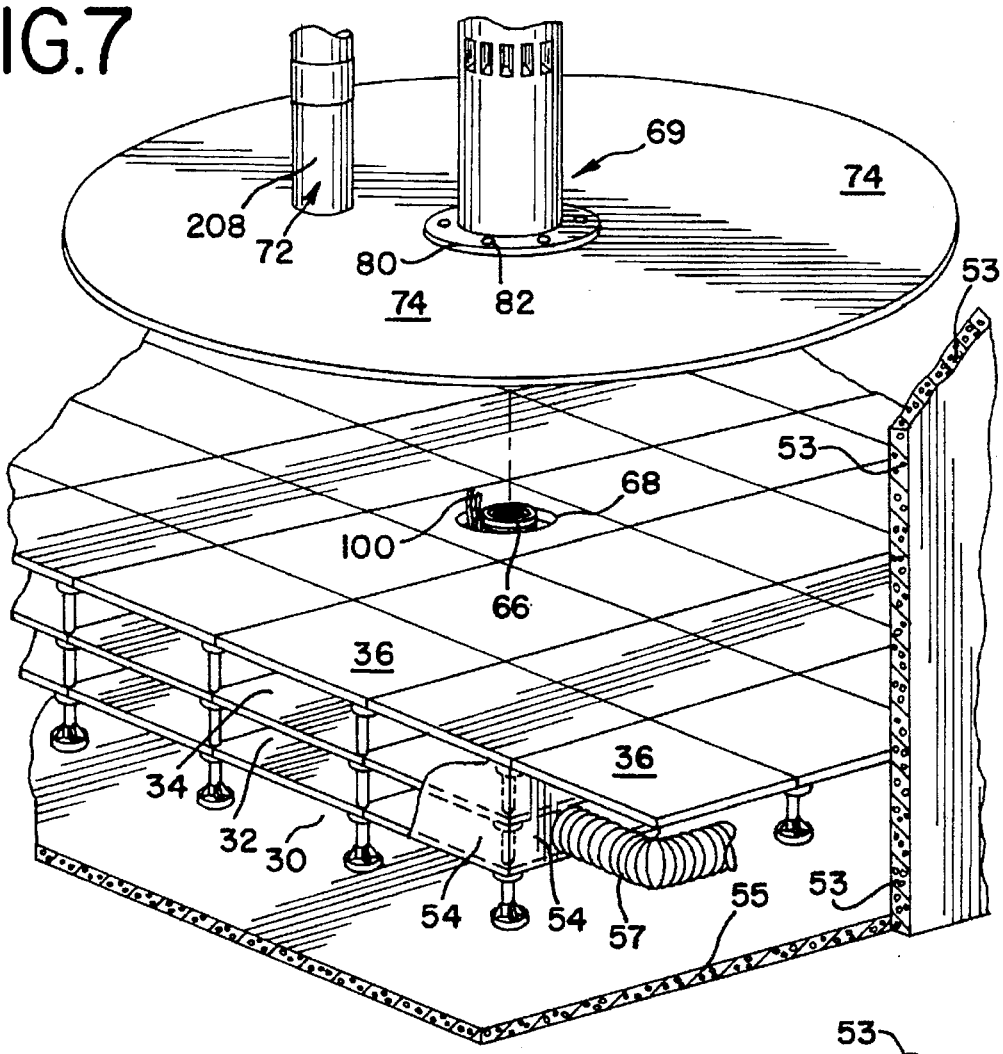
FIG. 7 is an exploded perspective view of the preferred form of floor usable with the invention and showing the positioning of the work station relative to the floor, including the preferred form of conditioned air and electrical connections.
Figure 8:
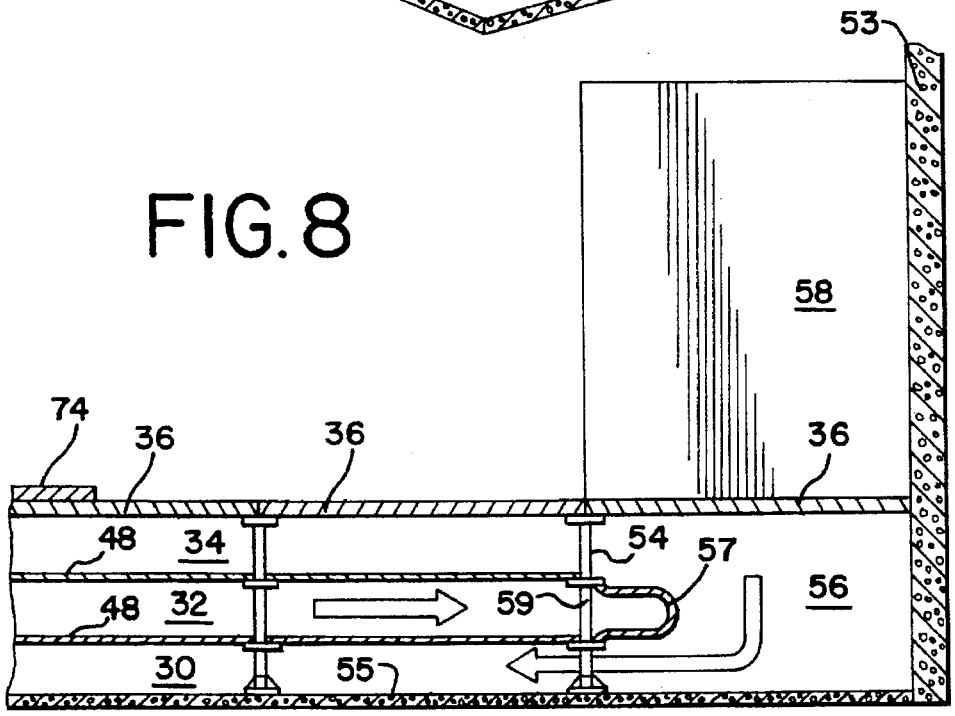
FIG. 8 is a vertical sectional view of portions of the floor supporting the work station and illustrating air flow and electric conductor positioning within the floor disposed beneath the unit.

Preferably, as best shown in FIGS. 7 and 8, perimeter walls formed by vertical peripheral panels 54 close off the outer ends of the two upper plenums 32, 34. The panels 54 extend between the work floor and the floor just above the building floor or slab 55 to complete the mechanical isolation between various levels. In this way, the services on various levels are mechanically isolated from each other for a number of reasons, including flexibility of wire and cable management, low cost compliance with fire and electrical codes, and more effective, lower cost, energy-saving air circulation.

Various details of the construction and arrangement of such floors are illustrated in U.S. Pat. No. 4,630,417, now Reissue Patent No. Re. 33,220, and U.S. Pat. No. 4,874,127, the latter of which illustrates a desirable way of controlling localized climate in a large room in response to heat load demand from computers or peripheral equipment.

Referring again to the interior office space 22 in which the apparatus 20 is positioned, the air supply space 30 is substantially coextensive with the room interior subfloor or slab area. This area is substantially free of obstructions such as a significant volumes of wires, cables, ducts and the like to provide for air circulation with minimum impedance. A peripheral space 56 (FIG. 8) of increased height, (i.e., from the slab 55 to the floor panels 36, and from the building walls 53 to the wall panels 54), surrounds the spaces 32, 34 and is in communication with a conditioned air source schematically shown as 58. This source may be a downflow unit, but in most office applications is simply a connection to a central source of conditioned air.

The next subfloor space 32 is a wide area plenum for returning the air provided in the supply space or plenum 30. Preferably, the space is also substantially free of internal obstructions, except that, occasionally one or more "chimneys" or vertical passages may extend through this space, such vertical passages generally designated 60, 62 (FIG. 3) having a cross-section smaller than any one individual floor panel. The outer periphery of the return air plenum 32 is preferably, but not necessarily of slightly less lateral extent than that of the supply air plenum 30 so that the peripheral space 56 just referred to can be provided. Details of the return air system are shown, schematically, i.e., it is shown in FIGS. 7 and 8 that a duct 57 may be placed with one end 59 communicating with the return air plenum space 32 and its other end (not shown) in communication with the inlet end of a heat exchanger forming a part of a climate control system. While not strictly necessary, the multi-level subfloor space described herein is normally the most effective and convenient way of practicing the invention. In some cases, other supply and return air and wire/cable arrangements may be preferred or acceptable.

Located above the return air plenum 32 is a wireway space 34 which also extends horizontally between peripheral panels 54 and which extends vertically between the upper level pans 48 and the work floor panels 36. This space is mechanically isolated from the supply and return air spaces below it and from the work space 26 above the floor 36. According to applicable electrical codes, this space 34 may contain electrical power and/or so-called data or signal cable which, as known to those skilled in the art, may be electrical, fiber optic, or of other appropriate construction.

In those applications wherein high and low voltage power are required to be isolated from each other, an additional level may be provided, or the higher voltage wires or cables may be protectively sheathed if this is more economical than providing a second wireway space or level. The wireway space intentionally does not contain circulated air and accordingly may be comparatively full of wires, cables, or the like for any necessary or desirable purpose.

Referring now to the preferred form of work station itself, and in particular to FIGS. 1–3, this unit is shown to comprise a lower, multi-service portion generally designated 61, an intermediate, equipment positioning portion generally designated 66 and an upper air supply and illumination portion generally designated 68. In addition, the work station includes a seating portion generally designated 70 and a base portion generally designated 72 (FIGS. 1 and 2). Functionally, the work station 20 may be thought of as also having three generally parallel but functionally different spaces, namely an air supply space generally designated 60, a return air space generally designated 62, and one or more wireway spaces generally designated 69*a*. In the preferred form, these spaces are concentric, but this is not a strict necessity.

Inasmuch as a functional connection must be made between whatever conditioned and return air sources are available and connections to one or more electrical sources must be made, adapters in the form of modular "chimneys"

or the like are preferred for use in connecting these services to the columnar structure forming the major part of the work station 20. Accordingly, in the subfloor area 28, a chimney module generally designated 63 is provided, with such module including a modified lower floor pan 48*a* and an upper modified floor pan 48*b*. The lower floor pan 48*a* is imperforate except that, in one portion thereof, there is formed in or attached to the pan 48*a* a rigid metal cylinder 64 extending in use to or just upwardly of a second floor pan 48*b*. This cylinder 64 is open at both ends and provides an adaptor/connector for appropriate parts of the work station.

The floor pan 48*b* includes a larger diameter stub cylinder 65, concentrically arranged with the cylinder 64 and providing an annular access space. According to the preferred form of invention, both the cylinder 64 and the stub cylinder 65 have affixed to their respective upper ends flexible connector tubes 67, 69. When these tubes and cylinders are connected to the work station 20 as shown in FIG. 3, there will be a vertical core passage from the air supply plenum 30 into the supply air passage 88 in the unit 20, and a concentrically arranged annular passage 92 for return air passing into the return air plenum 32.

Accordingly, wherever it is desired to create vertical connections between an air supply and/or air return space, these modular vertical "chimney" assemblies 63, preferably with concentrically arranged passages, may be provided. Because the subfloor area is preferably of modular construction, these "chimney" or vertical passage modules may be positioned at any desired place within the overall floor structure. By reason of their preferred form of construction, these units may also be relocated as desired with minimal expenditure and very little labor. Consequently, once the desired location of a work station has been determined, the wire-area supply and return air spaces may simply be "tapped into" by providing panels 48*a* that include the cylinder or like portions 64, 65, etc. forming vertical passages for supplying air to a returning air from the work area.

Referring now to the preferred form of the work station structure itself, the base section 72 comprises a circular flat plate 74 which may optionally include integral rollers 76 to permit rotary repositioning of the plate 74. In the preferred form, the lower, multi-service portion 61 of the apparatus 20 comprises a rigid exterior structural tube or shell 78 having a radial mounting flange 80 at the bottom thereof, such flange being used in connection with fasteners 82 to secure the shell 78 to the inner margin 84 of the plate 74.

The lower portion 61 of the apparatus 20 also includes an innermost rigid tube 86 defining a conditioned air supply passage 88, the lower portion of which is attached via the flexible tube 67 to the upper portion of the cylinder 64 and which places the supply air space 88 in communication with the subfloor air supply plenum 30. A radially intermediate, larger diameter tube 90 surrounds the inner air supply tube 86 and is disposed within the outer tube or shell 78 so as to define a return air space 92, preferably in the form of a cylindrical shell.

The lower portion of the tube 90 communicates with the flexible tube 69 defining the connector passage 62 that joins the return air plenum space 92 within the apparatus 20 to the subfloor return air space 32. A plurality of radially extending tubular passages 94 defined by imperforate walls 96 and having inlets 98 (FIG. 1) in the upper portion of the lower section 61 permit return air to be drawn from the work area space near the worker into the space 92 and ultimately into the subfloor return air space 32, thus insuring a desirable circulation pattern.

The foregoing arrangement also creates an interior wireway space 99 between the outer tube 78 and the O.D. of the intermediate tube 90. A plurality of electrical cables or the like 100 extend from the subfloor wireway space 34 through the annular opening 102 in the lower portion of the tube 78. The wires or cables 100 extend upwardly in the area between radial return air passages 94. As an optional feature, a door 104 is provided in the outer surface of the tube 78 to permit access to this wireway space if necessary for the purpose of making additional electrical connections.

An annular plate 106 closes off the upper ends of both the vertical return air space 92 and the wireway space 99. This plate 106 also serves as an interface for power and communication, i.e., the various plug receptacles, jacks and other outlets generally designated 107 are positioned by the plate 106 and the wires, cables, or the like 100 extend downwardly from these fixtures 107, through the vertical space 99, and through the annular passage 102 into the horizontal wireway space 34. A plug 109 with a power cord 111 is shown as an example of such arrangement.

Referring again to FIG. 3, it will be noted that, above the annular plate 106, the column serves additional functions and is of a different construction. Above the plate 106, the side walls of the outer tube 78 continue for a distance of a foot or so, while the innermost tube 86 forming the air supply column continues upward beyond the plate a distance sufficient to permit locating the equipment positioner rings generally designated 108. Beyond the rings 108, the inner tube or columnar side walls 86 continue toward and terminate at an upper end plate 110 having a center air discharge opening 112. Volume of air flow through the tube 88 from the air supply plenum 30 and out the discharge opening 112 is controlled by a motorized damper assembly generally designated 114. The assembly 114 includes a motor 116 mounted by a bracket 117 to the column side wall 86. A rotary shaft 118 positions a damper plate 120; the motor is energized by wires 122 and controlled by a demand thermostat/regulator (not shown) that is operator-controlled.

Figure 5:
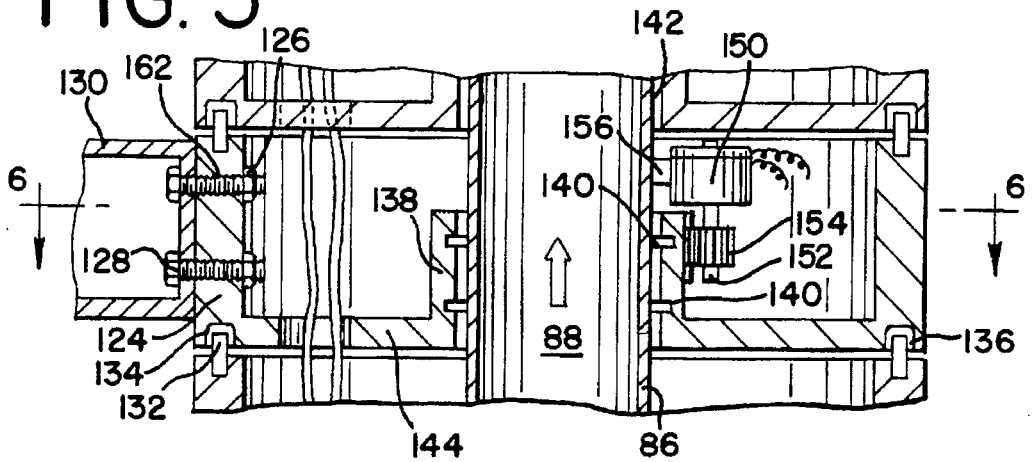
FIG. 5 is a fragmentary enlarged vertical sectional view of a center portion of the work station of FIG. 3, showing certain details of the equipment positioning rings and a form of powered apparatus for positioning the rings.
Figure 6:
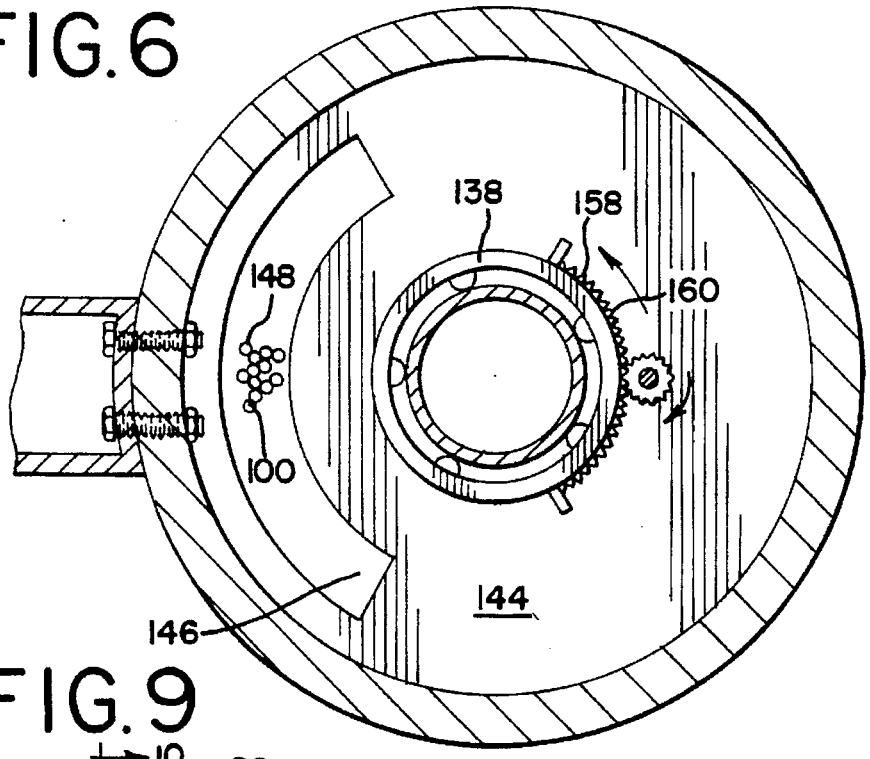
FIG. 6 is a horizontal sectional view, taken along lines 6—6 of FIG. 5 and showing additional constructional details of the equipment mounting rings.

Referring now to the center section 66 of the apparatus 20, an important feature of the invention is the plurality of mounting rings 108 for positioning worker equipment. Each of these mounting ring units 108 is shown in FIGS. 5 and 6 to be formed in a generally U-shaped cross-section, including an outer wall portion 124 which may include means in the form of captive nuts 126 or the like to receive fasteners 128 for positioning equipment support arms 130. A lower portion of the ring outer wall 124 includes plural, circumferentially spaced rollers 132 (only one shown in FIG. 6) each supported by an axle 134 and each being positioned in a pocket 136 formed within the ring outer wall. To prevent tilting of the ring under the eccentric load imposed by the equipment positioned by the support arm 130, the ring 108 also includes an interior vertical wall 138 which positions plural roller sets 140 adapted to engage the outer surface 142 of the air supply tube 86.

Each of the rings 108 also includes a radial flange or web section 144 having circumferentially extending, arcuate openings 146 permitting one or more bundles 148 of wires or cables 100 to extend vertically therethrough. Disposed opposite the portion of the ring 108 containing the slot 146 is a rack and pinion style power drive mechanism that includes a motor 150 having a drive shaft 152 carrying a pinion gear 154, the motor being mounted by a bracket 156 to the outer surface 142 of the tube 86. The teeth on the pinion gear 152 engage with counterpart teeth 158 on an arcuate rack 160 extending around a portion of the inner axial flange 138 of the ring 106.

Preferably, each of the rings 108 includes the pockets 136 and the rollers 132 at the ring lower end and also includes a groove 162 at its upper end to engage a counterpart roller. The uppermost roller set in the group is disposed in a circumferential carrier 164 extending around the inside of the outer tube 78. A counterpart support flange 166 is disposed below the lowermost ring. In this arrangement, the array of rings 108 is trapped between support flanges extending inwardly from the outer surfaces of the outer shell 78 and the entire stack of rings is held under sufficient compressive load by the combined action of the inner tube 86 and the outer tube 78 to permit free rotation of the rings about the center line axis of the air supply duct, but loosely enough that the rings are able to be rotated for positioning purposes, either manually or with the aid of the power device just described.

Referring now to the uppermost portion of the column center, FIGS. 3 and 4 show that there are a plurality of "tracks" generally designated 170 in the form of grooves 172 having spaced apart conductors 174 received therein and positioned so as to expose only a part of the conductors. These tracks are similar to the tracks of the type used with track lighting wherein a slidably movable mounting head 176 carries a spring-loaded pad 177, enabling the head 176 to be positioned within the track and moved when desired. Each of the tracks carries electrical connections and also a mast 178 or the like which may support a light fixture, such as the fixtures 180 shown in FIGS. 1–3, for example. A wand or mast 182 of another type may be used to position a board or screen 184 on which information may be projected or otherwise displayed or which may be used simply for providing privacy or minimizing distractions to the operator.

Referring now to the uppermost portion 68 of the columnar structure forming the major part of the work station 20, it will be noted that the outer tube 78, which is interrupted by reason of the rings 108, begins again above the rings and continues to the top of the column. The upper portion 68 of the column preferably includes inner auxiliary side walls 186 in contoured, outwardly curved or bell-mouthed form. A plurality of inwardly extending support webs 188 extend between the contoured walls 186 and the outer contoured walls 190 of the light assembly generally designated 192 and shown to have an open top portion 194, the contoured, curvalinear side walls 190 just referred to and a lower support plate 196 to which a fixture 198 is attached to carry a lightbulb 200. Preferably, ventilating passages 202 are provided in the plate 196 to permit air cooling of the light.

Referring now to FIGS. 1 and 2, it will be noted that the chair or seat generally designated 70 for the user includes a contoured back rest portion 204, a contoured seat section 206 supported on a vertically adjustable pedestal 208, the lower portion of which is secured to the support plate 74. In one preferred form, the chair 70 includes a side arm 210 having a receptacle 212 for a telephone handset 214. A combination telephone mouthpiece and microphone 215 for communication purposes is positioned by a flexible stalk 216 having a portion thereof secured to the back 204 of the worker. These components, as well as the keyboard and hand rest unit 218, the video monitor 220, the monitor support arm 130, the keyboard support arm 222 are all illustrated in the plan view of FIG. 2, which also shows the spacing of the webs 188 that position the light assembly 192.

Figure 9:
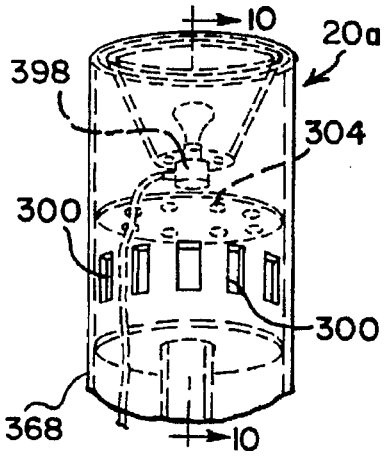
FIG. 9 is a fragmentary perspective view showing a modified form of apparatus 20*a* providing a slightly different form of supply air distribution.
Figure 10:
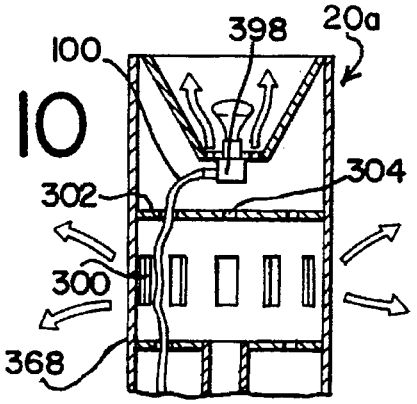
FIG. 10 is an enlarged vertical sectional view of the apparatus of FIG. 9, taken along lines 10—10 thereof.

Referring now to FIGS. 9 and 10, a slightly modified form of apparatus 20*a* is shown. Here, the overall arrangement of components is the same, but a series of radially outwardly directed ports or openings 300 are provided for air distribution adjacent the upper portion 368 of the column. An isolator plate 302 includes a few smaller openings 304 to permit air circulation in the vicinity of the light, but the major portion of the air coming from the passage 388 is directed radially outwardly through the ports or openings 300 as shown in the drawings. Such an arrangement may be preferred if for some reason it is desirable to position the light more closely adjacent the ceiling, to impart a stronger horizontal component to the air flow, for example.

In the earlier illustrated embodiment, the damper for air flow control was positioned in the uppermost portion of the air supply tube 86. However, it is understood that such a damper may be positioned in a lower part of the column, or in fact, outside the apparatus and in an appropriate portion of the floor, such as where the metal cylinder 64 forms the connector between the supply air plenum 30 and the inlet of the central air supply passage 88.

Referring now to the operation of the device, it will be assumed that a work station apparatus 20 as shown in FIGS. 1–3 and that the operator is desirous of utilizing the equipment in a controlled atmosphere. Here, the user takes a seat and may adjustably position the lights 180 by moving the wands 182, or the support arm 184 to position these units as desired. The arm 130 is manipulated either by actuating the motor 150 or by manual operation and the arms 222 supporting the keyboard assembly 218 are manipulated into a comfortable position for the operator. It is further assumed that they wire or cable connections such as to the cables 100, 111 have been made as desired to power the existing equipment or other optional equipment, as by inserting the plug 109 into the receptacle 107 positioned on the plate 106 Under normal operations, a supply of conditioned air is under sufficient pressure to cause air flow in the vertical air space 88 defined by the inner tube 86. Under the control of the motorized damper 120, the air will pass through the opening 112 in the plate 110, and following the contour of the walls 186, 190, will pass as shown by the arrows in FIGS. 1 and 3 into a pattern of a generally spherical shell, returning through the inlet openings 98, the passages 96, and into the return air space 92. This space being in communication with the return air plenum 32, controlled air circulation will be achieved in the vicinity of the operator. The positioning of the thermostat or manual control (not shown) may be done by locating such a control in the arm rest 212 or otherwise adjacent the chair 70. An automatic control sequence may be achieved by positioning an air temperature detector on the stalk 216 or elsewhere adjacent the user. In this arrangement, the usual feedback control between the set point and the supply air control prevails and the temperature will be maintained as desired in the vicinity of the user.

According to the invention, the concentric arrangement of services, with the wireway space being adjacent the outer part of the column, the return air space in the middle and the supply air space in the innermost tube is a desirable feature of construction for several reasons. In particular, this simplifies a construction of the rings or the like in that the services requiring the greatest vertical extent are those of the supply air and to a lesser extent, the power. The return air is specifically designed to provide passages above the floor level but preferably below the waist level of the user, to achieve the most desirable circulation pattern.

In the preferred form of apparatus, arcuate adjustment is desirable and shapes that are circular and cross-sectional are the logical enhanced preferred way of achieving these design criteria. However, the principles of the invention are operative even if the services are not arranged concentrically, i.e., in shells about a center core. However, this arrangement is preferred in keeping with the modularity and universality concepts that provide the greatest flexibility.

As shown in FIG. 2, potted plants 199 or the like may be positioned on the plate or elsewhere adjacent the user to assist in $O_2/CO_2$ balance and improve indoor air quality, to absorb sound, provide visual screening, etc. For clarity of illustration, auxiliary functions such as paper storage or the like, or the provision of other readily positionable machines has been omitted, but will be understood that their presence or absence is not a necessary feature of the invention. The height of the main column and the height of the air supply discharged above the ground will depend on the ceiling and conditions generally surrounding the user. Accordingly, the possibility that air may exit the column above the user but below the top of the column is shown as an alternative construction in FIGS. 9 and 10.

A form of invention has been illustrated wherein "chimneys" are shown and described that show concentric passage of supply and return air from a module and a multi-level floor construction. In some instances, particularly those in an office wherein there is only a modest number of obstructions beneath the floor, and a single subfloor air supply space exists, the modified form of connection may be used. In this instance, a booster fan or the like may be disposed at or near the foot of the air supply tube 88. The connector arrangement shown would be dispensed with and a duct would be provided for moving return air from the base of the column to the inlet of the heat exchanger for recirculation. Likewise, the electrical or other cables are shown as coming from their own wireway level; however, these wires and/or cables may be supplied to the apparatus by way of exterior sheathing such as trough or conduit, and enter the wireway space in that way rather than through an annular opening as illustrated. A door 104 is shown as providing access for a plug and a representative receptacle has been shown in a desired position. However, the provision of spaces that are mechanically isolated from each other and are individually dedicated to the various functions may be achieved by different constructions.

As shown and described herein, and as referred to in the claims, it is anticipated that, in most applications, the air supply outlet will be in, at or near the top of the column and that the return air inlets will be near the base of the column. Naturally, the exact location of these outlets and inlets will importantly depend on the configuration of the room, the overall height of the column, the distance of the light from the ceiling, the positioning of the operator and other variables. Accordingly, expressions such as "adjacent the top" of the column mean above the worker and within an upper portion of a normal height column, i.e., 6–9 ft. In an extreme case, of course the column may for some reason be extremely high and have lights or outlets well above the user but with the air supply outlet not truly at or near the top of the column. In such cases, the uppermost part of such possible column would not be considered a functional portion of the column.

Likewise, the return air inlet should preferably be at or around the knee level of a person standing such that the return air circulation is passing generally either or both downwardly and parallel to the floor when returning. Hence, the height of the return inlets is generally said to be adjacent the lower portion of the column, but this does not imply an exact height so much as a functional relation.

Moreover, the positioning of the various rings may vary with the overall construction of the apparatus, but the position of such rings also depends upon the type of equipment being positioned and the extent to which the arms are arranged. Hence, such rings or tracks for lighting may be well above or lower on the unit than illustrated, although this would not be preferred in most circumstances.

It will thus be seen that the present invention provides a new and improved work station with climate control capabilities having a number of advantages and characteristics including those herein pointed out and others which are inherent in the invention. It is anticipated that variations and modifications of a described form of apparatus may be made without departing from the spirit of the invention, or the scope of the appended claims.

I claim:

1. A work station for office or clerical workers comprising, in combination, a support plate, a user seat positioned on a portion of said support plate and adapted to seat a worker in a desired position, a service distributor unit extending vertically and having its lower portion fixedly mounted to a portion of said support plate, said distributor unit including vertically extending walls defining an interior air supply space with a lower opening providing access to an area beneath said support plate, said space extending at least to a position adjacent the top of said distributor unit, interior walls at least partially defining a vertically extending return air space, separate from said supply air space, said return air space including at least one air inlet adjacent a lower portion of said distributor unit and having a return air outlet communicating with the space beneath said support plate, and additional vertical walls defining an interior wireway space and separating said wireway space from supply and return air spaces, a plurality of equipment positioners adjustably mounted with respect to a central portion of said work station and including support arms for positioning equipment to be used by seated workers positioned in said seat, with said wireway space providing a passage for conductors, extending from beneath said support plate through said wireway space and to said equipment positioned by said support arms.

2. A work station as defined in claim 1 which further includes a light positioned within the upper portion of the work station interior to furnish indirect lighting to the vicinity of said station.

3. An apparatus as defined in claim 1 wherein said equipment positioners are in the form of rotatable rings.

4. A work station as defined in claim which further includes a plurality of track lights positioned adjacent an upper portion of said work station.

5. A composite work station including a climate control and an electrical distribution capability, said work station comprising, in combination, a vertically extending, substantially hollow column structure, said column structure including interior walls dividing said hollow interior into an air supply space extending between the lowermost portion of the column and an upper portion of the column, an air supply outlet adjacent said upper portion of said column, a return air space having at least one inlet near the lower portion of said column, an electrical space isolated from said return air space and said air supply space, said electrical space including a wall portion for receiving an outlet receptacle, at least one receptacle positioned by said wall, plural equipment positioners affixed to a central portion of said column, said equipment positioners being vertically arranged with respect to one another and being movable about the center of said column, each of said positioners including an equipment support arm extending outwardly therefrom, an air volume control unit permitting the operator to regulate the volume of air flowing through said air supply space, and with said air supply and return spaces and said electrical space each including an open passage for communication with an area beneath said column structure.

6. A combination work station and climate control apparatus comprising, in combination, a main support plate, a user seat supported on and positioned by said support plate, a vertically extending, hollow air supply column permitting air to flow from a space beneath said support plate through an inlet at the bottom of said column to an outlet above said user seat, horizontal and vertical walls defining an inner air return space having inlet openings adjacent said user seat and at least one outlet communicating with a space beneath said support plate, additional walls defining an electrical conductor space separated from said air spaces and extending from beneath said support plate to a receptacle mounting area adjacent said user seat, and a plurality of adjustable equipment positioning rings mounted for movement about at least one of said air and electrical spaces, said apparatus further including a control for regulating the volume of air flow through said air supply column to provide climate control for said user.

7. A combination work station and climate control apparatus comprising, in combination, a multi-level raised floor including a work area floor substantially coextensive with the walls of a room in which said raised floor is to be installed on a base floor, at least one subfloor positioned beneath said work floor and in use spaced upwardly apart from said base floor of the building in which the apparatus is installed, a plurality of vertical panels extending between the outer periphery of said subfloor and upwardly to said work floor so as to divide the area beneath said floor into at least upper and lower, mechanically separated subfloor spaces, at least one vertical passage extending from a portion of said lower space through said upper space and to provide communication between said space above said work floor and said lower subfloor space, at least one providing a path of communication between said upper subfloor space and the space above said work floor, a combination work station and climate control apparatus positioned on said work floor, said work station including a vertically extending main structure having portions thereon for supporting and adjustably positioning equipment to be used by worker at said work station, and at least two mechanically separate, vertically extending spaces within said main structure, one of said spaces being an air supply space extending from one of said subfloor spaces to an outlet adjacent the upper end of said main structure, and the other being an electrical space in communication with the other of said subfloor spaces, and a flow control unit in at least one of said subfloor spaces and said main structure for controlling the flow of supply air from said subfloor space through said main structure.

8. An apparatus as defined in claim 7 wherein said at least upper and lower subfloor spaces comprise a third mechanically isolated subfloor space, wherein said at least two vertically extending spaces in said main structure further includes a third vertical space for return air, with said third subfloor space and said third vertical spaces are in communication with each other.

9. An apparatus as defined in claim 7 wherein said lower subfloor space is an air supply space, wherein said upper subfloor space is a wireway space.

10. An apparatus as defined in claim 7 wherein said upper subfloor space is a return air space.

11. An apparatus as defined in claim 8, wherein said third subfloor space is an air return space, said lower subfloor space is an air supply space, and said upper subfloor space is an electrical wireway space.

* * * * *